US007615726B2

(12) United States Patent
Shah et al.

(10) Patent No.: US 7,615,726 B2
(45) Date of Patent: Nov. 10, 2009

(54) IDENTIFICATION OF ELECTRIC HEATER CAPACITY

(75) Inventors: Rajendra K. Shah, Indianapolis, IN (US); Eugene L. Mills, Jr., Avon, IN (US); Jerry D. Ryan, Indianapolis, IN (US)

(73) Assignee: Carrier Corporation, Farmington, CT (US)

( * ) Notice: Subject to any disclaimer, the term of this patent is extended or adjusted under 35 U.S.C. 154(b) by 466 days.

(21) Appl. No.: 11/368,178

(22) Filed: Mar. 3, 2006

(65) Prior Publication Data

US 2006/0153548 A1 Jul. 13, 2006

Related U.S. Application Data

(62) Division of application No. 10/707,524, filed on Dec. 19, 2003, now Pat. No. 7,039,300.

(51) Int. Cl.
*H05B 1/02* (2006.01)

(52) U.S. Cl. ..... 219/506; 219/486; 219/487; 392/360

(58) Field of Classification Search ..... 219/483–488, 219/506, 509; 392/360, 363–369, 379–385; 236/3, 49.1
See application file for complete search history.

(56) References Cited

U.S. PATENT DOCUMENTS

| | | | |
|---|---|---|---|
| 2,647,198 | A | 7/1953 | Lautner |
| 5,014,210 | A | 5/1991 | Postlewait |
| 5,170,042 | A | 12/1992 | Bunn |
| 5,911,895 | A | 6/1999 | Porfido |
| 6,441,352 | B1 | 8/2002 | Groft |
| 6,624,397 | B2 | 9/2003 | Tateishi |
| 6,740,085 | B2 | 5/2004 | Hareyama |
| 6,803,544 | B1 | 10/2004 | Zikes |
| 6,873,792 | B2 | 3/2005 | Lo |
| 2004/0082971 | A1 | 4/2004 | Miura |
| 2005/0121495 | A1 | 6/2005 | Yokoyama |

FOREIGN PATENT DOCUMENTS

| | | |
|---|---|---|
| JP | 11-52769 | 2/1999 |
| JP | 2002-324652 | 11/2002 |
| WO | 93/19563 | 9/1993 |

*Primary Examiner*—Mark H Paschall
(74) *Attorney, Agent, or Firm*—Carlson, Gaskey & Olds, P.C.

(57) ABSTRACT

An electric heater is provided with an identifying resistor associated with a connection between the heater and a fan control. When the electric heater is connected to the control, the identifying resistor provides information with regard to the capacity of the particular electric heater that is being attached to the control. The control then utilizes this particular capacity to control both the electric heater and an associated fan motor.

3 Claims, 3 Drawing Sheets

| HEATER NO. | RESISTOR OHMS NOMINAL | HEATER SIZE KILOWATTS |
|---|---|---|
| 0 | OPEN | NO HEATER |
| 1 | 5.1k | 5 |
| 2 | 11k | 9 |
| 3 | 18k | 15 |
| 4 | 24k | 20 |
| 5 | 33k | 24 |
| 6 | 39k | 30 |
| 7 | 51k | FUTURE EXPANSION |
| 8 | 62k | FUTURE EXPANSION |
| 9 | 75k | FUTURE EXPANSION |
| 10 | 91k | FUTURE EXPANSION |
| 11 | 120k | FUTURE EXPANSION |
| 12 | 150k | FUTURE EXPANSION |
| 13 | 180k | FUTURE EXPANSION |
| 14 | 220k | FUTURE EXPANSION |
| 15 | 270k | FUTURE EXPANSION |

FIG.3

IDENTIFICATION OF ELECTRIC HEATER CAPACITY

RELATED APPLICATIONS

This application is a divisional of U.S. patent application Ser. No. 10/707,524 which was filed Dec. 19, 2003 now U.S. Pat. No. 7,039,300.

BACKGROUND OF THE INVENTION

This invention relates to an electric heater that carries an identifying characteristic to communicate the capacity of the electric heater to a control.

Electric heaters are utilized in many heating applications. Typically, an electric heater has electric coils that generate heat. An associated fan blows air over the coils, and the air is heated, and then delivered into a space to be heated.

A control is typically associated with at least the electric fan, and preferably the electric heater. The control receives signals, such as a demand signal from a thermostat, and actuates the electric heater and fan, as appropriate, to provide the demanded environmental conditions.

Among the items that must be communicated to more modern fan controls is the capacity of the electric heater. To provide optimum efficiency, the desired temperature and to provide most reliable operation, the control operates the fan motor dependent upon the capacity of the electric heater. However, in the field, there are many available heater capacity options. Thus, when installing a heater, a control for the fan must be configured to be provided with information on the actual capacity of the installed heater. It is often the case that this configuration is done improperly by the installer. The control then does not provide optimum operation.

SUMMARY OF THE INVENTION

In the disclosed embodiment of this invention, an electric heater is provided with a reporting characteristic that provides control information with regard to the capacity of the electric heater. In a preferred embodiment, an electrical connection between the electric heater and a control includes some electrical characteristic that provides an electrical signal corresponding to the capacity of the electric heater. Most preferably, an identification resistor is included into the electric heater, and is associated with a particular capacity. The control is also a control for controlling a fan coil, such that the fan can be operated at an optimum level to provide the desired temperature, efficiency, and reliability given the actual installed electric heater capacity.

These and other features of the present invention can be best understood from the following specification and drawings, the following of which is a brief description.

BRIEF DESCRIPTION OF THE DRAWINGS

FIG. 3 shows an exemplary look-up table.

DETAILED DESCRIPTION OF THE PREFERRED EMBODIMENT

Figure 1:
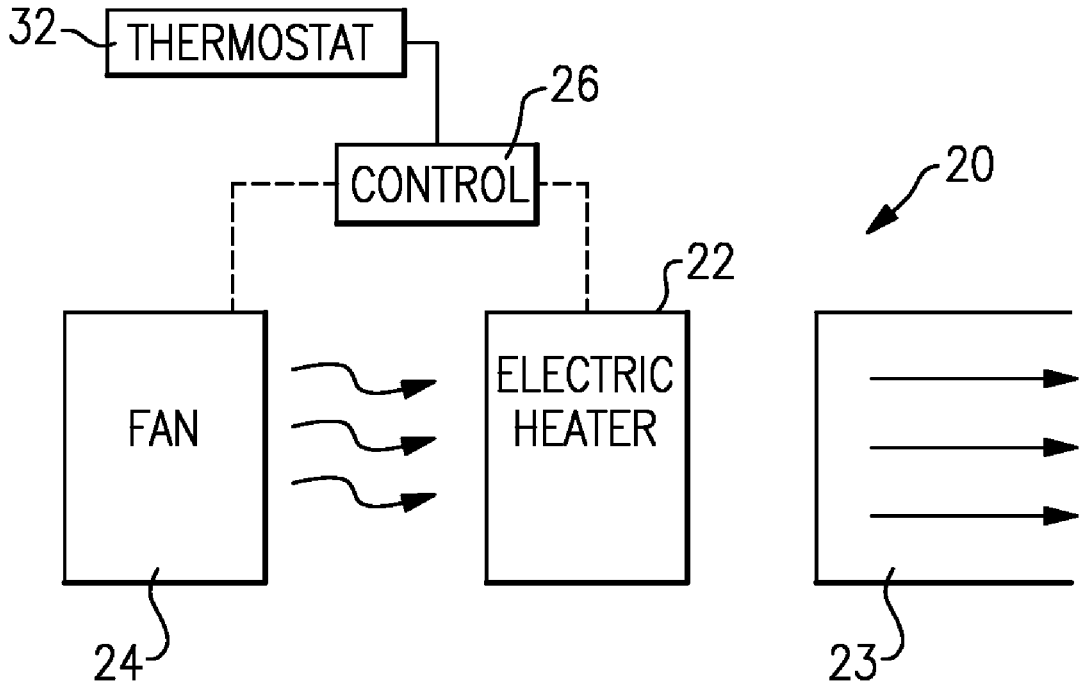
FIG. 1 schematically shows a fan and heater combination.

FIG. 1 schematically shows system 20 for providing heated air to an environment. As known, an electric heater 22 generates heat through electric heating elements. A fan blows air over the electric heater elements to be heated. The air is delivered into ducting 23, and then to the environment. A control 26 controls the fan and the heater, dependent upon a desired state, such as may be requested through a thermostat control 32.

Figure 2:
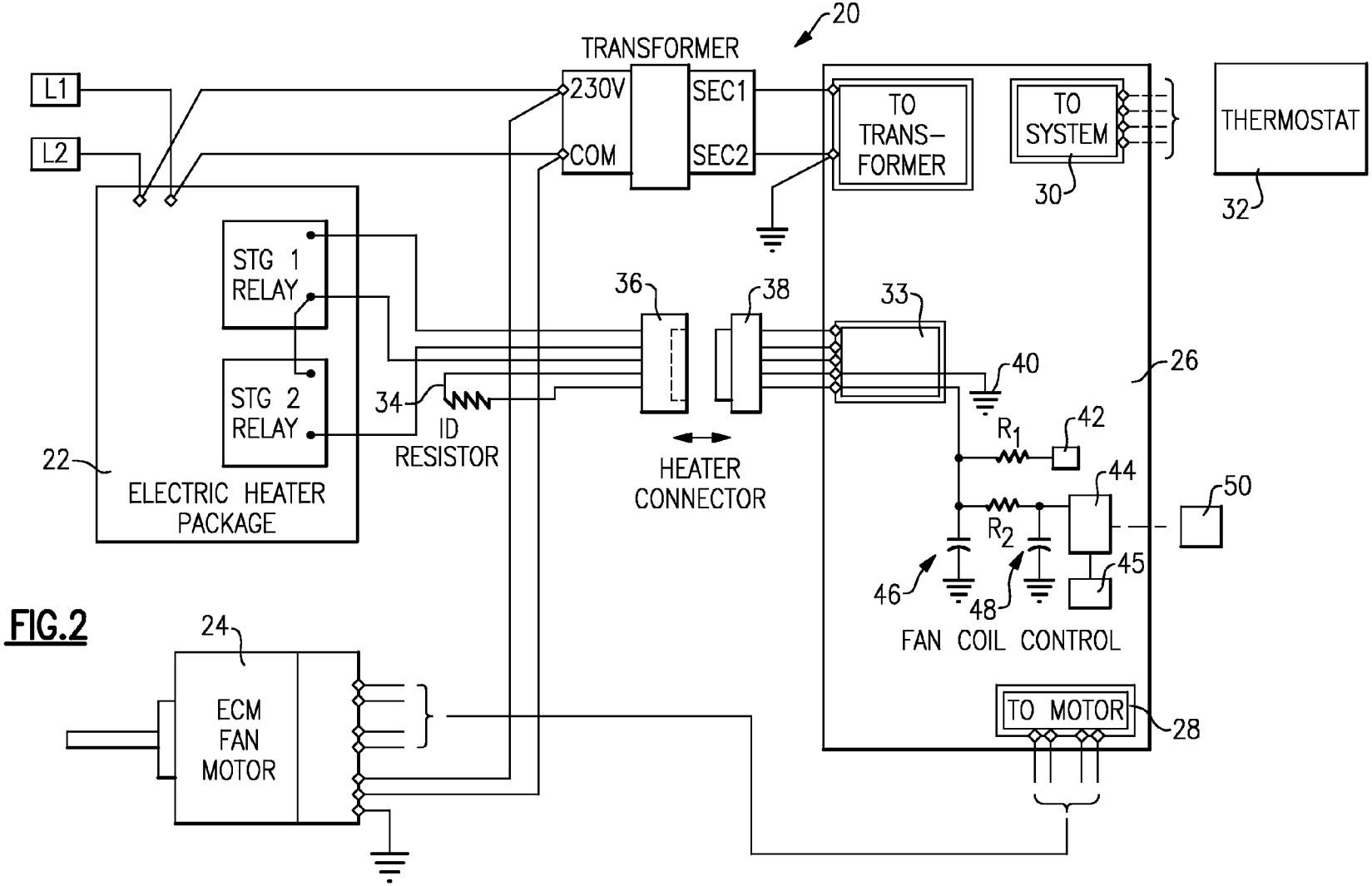
FIG. 2 is a schematic wiring chart.

FIG. 2 is a wiring diagram for the inventive system 20. As shown, the electric heater 22 has an identifying resistor 34. A wire harness connection 36 and 38 provides information exchange between the heater and the control as shown at 33. As shown also, the control 26 receives information at 30 from the thermostat 32, and at 28 to and from the motor 24.

The control 26 operates to take signals in from the thermostat 32, and to control the fan 24 and electric heater 22 to achieve a demanded level of heated air to an environment.

The provision of the identifying resistor 34 ensures that the control 26 will determine the capacity of the electric heater, once the connection 36 and 38 is made. Thus, a distinct identifying resistor value would be associated with each of the available capacity levels for the electric heater 22. Such information would be stored in the control 26, and related to the various capacities of available electric heaters at 33. Once the connection 36 and 38 is made, an electrical signal is sent to the control 26 such that the control 26 has reliable information with regard to the capacity of the heater 22. While an identifying resistor is preferred, other ways of providing an electric identifier would come within the scope of this invention. In the past, information with regard to the heater capacity has been entered manually, and has sometimes been improperly entered.

In the preferred embodiment, and as can be seen, when the electrical connection 36 and 38 is made, the identifying resistor 34 is connected to a circuit to control 26. Identifying resistor 34 has two ends, connecting into mating wires in the control half of the electrical connection 38. Common line 40 is connected to one end of the two connections to the identifying resistor 34. The other end of the identifying resistor 34 is connected to a DC voltage source 42 through a first resistance $R_1$. The microprocessor 44 is provided with a second connection through a resistor $R_2$, and a noise suppression and protection circuit provided by a pair of capacitors 46 and 48. As shown also, the microprocessor 44 preferably communicates with a look-up table 45. The voltage supplied by the source 42 is modified by the known resistance $R_1$. Essentially, a voltage divider is created, and the voltage sensed by the microprocessor 44 can be evaluated to determine the resistance of the identifying resistor 34. If the sensed voltage is VD, and the resistance of the identifying resistor 34 is RH, then the sensed voltage VD=:

$$VD=\text{voltage}_{DC}*RH/(RH+R_1)\text{ volts}$$

The microprocessor preferably has a built-in analog to digital converter that converts the voltage VD to a digital number. The microprocessor software then utilizes the above calculation to back-calculate the value of RH, which can then be compared to the values in a look-up table (see FIG. 3).

If there is no match, some signal may be provided to the installer that the heater capacity must be manually entered, such as on display 50.

In one preferred embodiment, the voltage DC was five volts, the $R_1$ value is 100 kohm, and the $R_2$ value is 10 kohm. The capacitors 46 and 48 are values of 0.01 μF and 0.1 μF, respectively. Of course, these values are merely exemplary.

The above-described circuit on the control side is also exemplary. Many variations would be readily apparent to a worker of ordinary skill in the electrical control art. As an example, the analog to digital converter could be external to the microprocessor, and rather than a voltage divider circuit, a current source circuit could be utilized. In a current source current, a fixed known current (IS) is sourced into the heater identifying resistor and the voltage (VS) across it is measured. The resistor value of the identifying resistor RH is then calculated by:

$$RH=VS/IS$$

Further, while a look-up table is disclosed, the circuit and the identifying resistance could be simply designed such that the value VD, or RH, can be input into a mathematical formula to compute heater capacity. With either the look-up table or this formula, a worker of ordinary skill in the art would recognize that some pre-determined tolerance range should be incorporated into the microprocessor for identifying the particular heater size. Further, the microprocessor may merely associate the initially identified voltage with the look-up table or formula, rather than calculating the resistance.

FIG. 3 shows exemplary resistances for various sized heaters. Of course, the invention is not limited to these particular resistances.

The capacity of the heater is used by control 26, such that the amount of air delivered by the fan 24 is appropriate given the capacity of the heater 22 and the demand.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A family of electric heaters comprising:

a plurality of electric heaters each having electric heating elements for delivering heat, said family of electric heaters having a plurality of heating capacities; and a connection to be connected to a control for each of said family of electric heaters, said family of electric heaters each having an identifying characteristic to provide to the control when an electrical connection is made between each of said family of electric heaters and the control is made, said identifying characteristic associated with each of said family of electric heaters providing information on the capacity of each electric heater in said family of electric heaters to the control, such that the control can identify the capacity of the particular electric heater of said family of electric heaters.

2. The family of electric heaters as set forth in claim 1, wherein each of said identifying characteristic is provided by an identifying resistor, with distinct identifying resistors being associated with different levels of capacity for said family of electric heaters.

3. The family of electric heaters as set forth in claim 2, wherein said identifying resistors are positioned within a wire harness for connecting said electric heater to a control.

* * * * *

UNITED STATES PATENT AND TRADEMARK OFFICE

CERTIFICATE OF CORRECTION

PATENT NO. : 7,615,726 B2
APPLICATION NO. : 11/368178
DATED : November 10, 2009
INVENTOR(S) : Shah et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 718 days.

Signed and Sealed this

Nineteenth Day of October, 2010

David J. Kappos

David J. Kappos
*Director of the United States Patent and Trademark Office*